US005655256A

United States Patent [19]

Hendrix et al.

[11] Patent Number: 5,655,256

[45] Date of Patent: Aug. 12, 1997

[54] DUCT CLEANING APPARATUS

[75] Inventors: Bill Hendrix; Frank Goodman; David Harvey, all of Calgary, Canada

[73] Assignee: Tim Hendrix, Calgary, Canada

[21] Appl. No.: 433,825

[22] Filed: May 4, 1995

[30] Foreign Application Priority Data

Mar. 15, 1995 [CA] Canada ..... 2144679

[51] Int. Cl.[6] ..... B08B 9/02

[52] U.S. Cl. ..... 15/395; 15/398; 15/410

[58] Field of Search ..... 15/304, 395, 398, 15/410, 393

[56] References Cited

U.S. PATENT DOCUMENTS

| | | | |
|---|---|---|---|
| 1,869,730 | 8/1932 | Antle . | |
| 2,056,850 | 10/1936 | Goughnour | 15/410 X |
| 2,509,604 | 5/1950 | McGregor . | |
| 3,800,358 | 4/1974 | Ryan . | |
| 4,473,921 | 10/1984 | Weber et al. . | |
| 4,546,519 | 10/1985 | Pembroke . | |
| 4,573,232 | 3/1986 | Marley . | |
| 4,792,363 | 12/1988 | Franklin, Jr. et al. . | |
| 5,311,637 | 5/1994 | Broussard . | |
| 5,472,514 | 12/1995 | Grimsley | 15/395 X |

FOREIGN PATENT DOCUMENTS

| | | |
|---|---|---|
| 1195059 | 10/1985 | Canada . |
| 0 598 943 A1 | 1/1994 | European Pat. Off. . |
| 9350 | 7/1899 | United Kingdom . |
| 285510 | 6/1928 | United Kingdom . |
| 2070640 | 9/1981 | United Kingdom . |
| WO85/02565 | 6/1985 | WIPO . |

*Primary Examiner*—Chris K. Moore
*Attorney, Agent, or Firm*—Biebel & French

[57] ABSTRACT

The present invention relates to an efficient duct cleaning apparatus that is readily adaptable for use in both rectangular and round ducts. In one embodiment, the invention provides a brush member with a hollow channel along the lower surface of the brush that enables dirt and debris within a ventilation system to be readily dislodged and removed by vacuum. The brush is also provided with an adaptor that enables rapid exchange of brushes from the vacuum source in order that the duct cleaning apparatus may be adapted for use in ducts having different sizes and profiles.

9 Claims, 5 Drawing Sheets

DUCT CLEANING APPARATUS

FIELD OF THE INVENTION

The present invention relates to an efficient duct cleaning apparatus that is readily adaptable for use in both rectangular and round ducts.

BACKGROUND OF THE INVENTION

In buildings having ducted air ventilation systems, it is well known that through normal operation of a furnace or air conditioning system, the ducts in the system will gradually collect and deposit a large amount of dust and debris. The collection and deposit of excessive amounts of dust or debris within the ventilation system of a residential or commercial buildings affects the efficiency of the ventilation system requiring increased maintenance of the air moving equipment as well as higher energy costs. Furthermore, the overall air quality within the building is affected. Excessive amounts of dust or debris may provide a health hazard to people within the building contributing to conditions such as allergies, asthma or respiratory disorders.

Accordingly, it is necessary for ductwork to be periodically cleaned of any deposited materials in order to ensure proper airflow as well as to minimize any health hazards within the building.

If a ventilation system has been neglected for an extended period of time, the deposits within the ducts of the ventilation system may be particularly tenacious to remove. In particular, the lower horizontal surfaces of the ducts are more susceptible to the gradual build-up of debris, often forming a dense mass of materials which strongly adhere to the duct surfaces. These deposits may comprise such contaminants as dirt, hair, clothing fibres, left-over construction materials, decaying organic matter and a variety of dead or active organisms such as dust mites, bacteria, fungus, viruses or pollen. Other contaminants may also be in the system. The vertical and overhead surfaces of the ducts generally collect more loosely adhering dust or dirt.

In order to properly clean the ducts of a ventilation system, a building owner often hires a contractor who has the specialised equipment necessary to properly clean the ventilation system. A large number of cleaning systems have been developed over the years which may be used to remove material from a duct system. Examples of past systems include, U.S. Pat. No. 4,792,363 which discloses a vent cleaning system which has a brush component that may be rotated about a flexible shaft in order to dislodge dirt from the duct system which may then be vacuumed into a vacuum conduit also within the rotating shaft, U.K. Patent 9350, issued Jul. 22, 1899, which discloses an apparatus for improving the removal of dusty deposits from a suffice and U.S. Pat. No. 1,869,730 which discloses an apparatus for cleaning tubes comprising two separate brushing surfaces, each of the underlying surfaces having a plurality of inlets through which dislodged material may be suctioned therefrom. Other systems such as those disclosed in PCT application WO85/02565 and U.S. Pat. No. 4,473,921 also disclose duct cleaning apparatus.

These past systems, however, have been limited in a number of ways, principly by the complexity of the system and, hence, cost, or alternatively by the adaptability of the system to efficiently clean ducts having both round and rectangular cross sections, typically found in the hot air delivery and cold air return portions of the ventilation system respectively.

Furthermore, it is often the case that a duct cleaning contractor may operate a related business such as carpet cleaning, both of which utilize vacuum equipment, often located in the contractor's truck or van. In that the power source for both a carpet cleaning and duct cleaning operation requires a strong vacuum pump with a high airflow, in the past there has been a need for duct cleaning apparatus which may be quickly and easily adapted to a typical vacuum hose which may be used with carpet cleaning equipment. Accordingly, there has been a need for a simple and inexpensive duct cleaning apparatus that uses an existing vacuum power source, such as that used in the carpet cleaning business to provide suction power for removing dirt and debris from duct work.

In the past, there has also been a need for a system that effectively removes the more tenacious deposits typically found on the lower horizontal surfaces of rectangular ducts. Thus, there has been a need for equipment which provides localized vacuum power to a brushing device and that focusses the majority of the vacuum power to the lower surfaces for removing the lower deposits as well as removing dirt dislodged from the remaining surfaces.

Accordingly, there has been a need for duct cleaning equipment that is quickly and easily adaptable to duct work of different sizes and cross-sections, such as round and rectangular ducts, where a vacuum hose can be easily removed and applied to a brushing head having a different cross-section to effectively provide and apparatus for the dislodging and removal of debris from the ducts.

SUMMARY OF THE INVENTION

In accordance with the invention, a duct cleaning apparatus is provided, the duct cleaning apparatus including a brush member having a body with top, bottom, side, front and back surfaces, the bottom surface having a hollow portion; bristles extending outwardly from the top, bottom and side surfaces; an aperture on the body extending from the front surface to the hollow base portion; and, connecting means; and, adaptor means having a base portion having a brush side and mount side, the base portion with a vacuum aperture extending through said base from the brush side to the mount side; vacuum hose connecting means on the mount side for receiving and connecting a vacuum hose to the vacuum aperture; attachment means on the base portion for securing the adaptor means to the connecting means; rod connector means on the mount side for connecting a rod to the base portion; and sealing means on the brush side for sealing the adaptor means with respect to the brush member.

In a preferred embodiment, the bottom surface and hollow portion define a perimeter lip around the bottom surface, the lip having a plurality of downwardly projecting bristles.

In further embodiments, the connecting means and attachment means are selected from any one of or a combination of locking stanchions, nuts and bolts or hinges, the vacuum hose connecting means include a threaded portion for connecting a vacuum hose to the base portion, the rod connecting means include a rod receiving portion and thumbscrew for connecting a rod to the base portion and/or the sealing means is a rubber gasket on the brush side.

In an alternate embodiment, the duct cleaning apparatus comprises a brush member having a hollow central body with a vacuum hose connecting portion for connecting a vacuum hose to the hollow central body, a suction portion, the suction portion having an end cap on the hollow central body and side apertures and a bristle portion with outwardly extending bristles between the vacuum hose connecting portion and suction portion.

BRIEF DESCRIPTION OF THE DRAWINGS

These and other features of the invention will be more apparent from the following description in which reference is made to the appended drawings wherein.

DETAILED DESCRIPTION OF THE INVENTION

Figure 1:
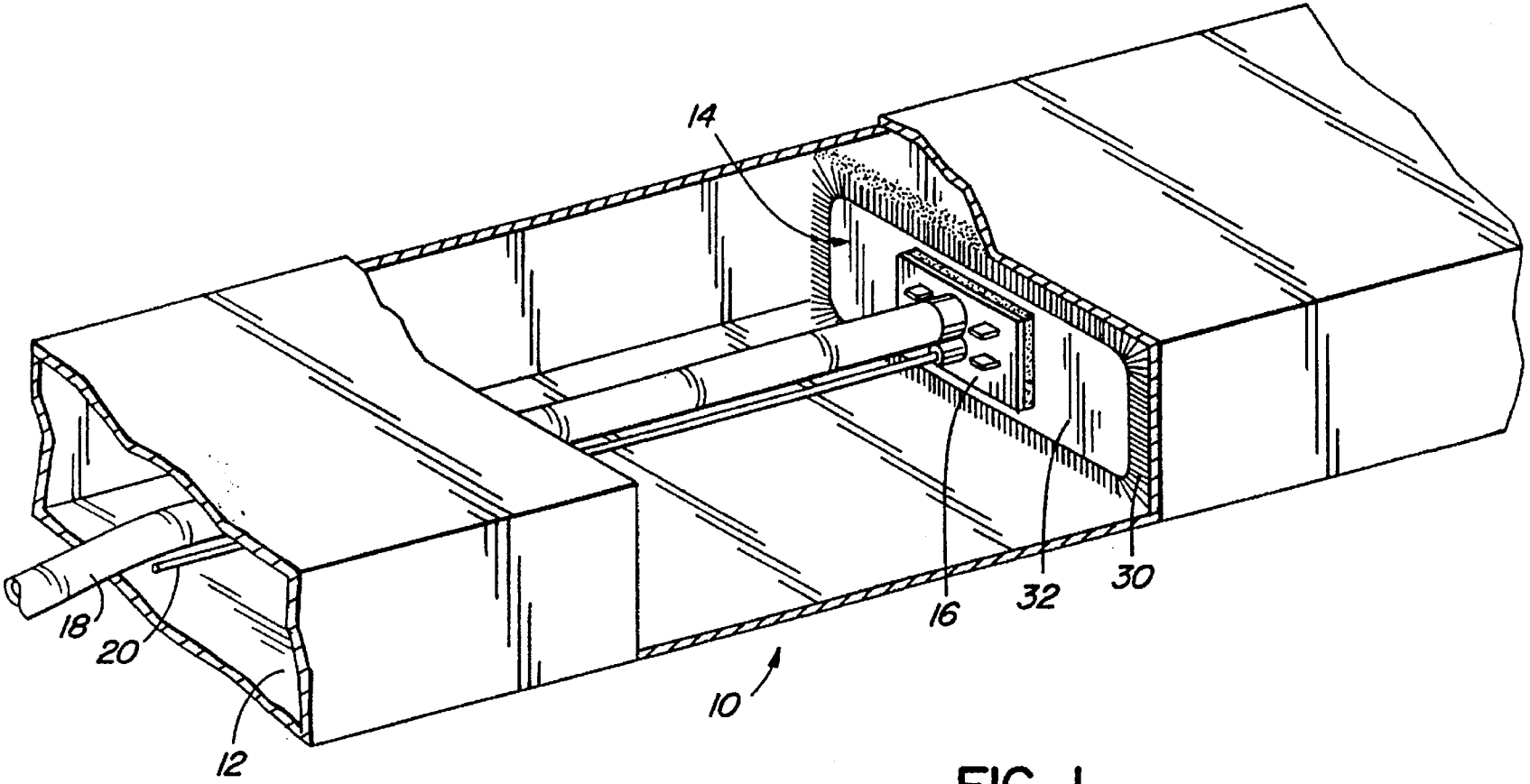
FIG. 1 is a perspective view of the duct cleaning apparatus in accordance with the invention in a duct of rectangular cross-section, the duct being partially cut away.

A duct cleaning system 10 is shown in accordance with the invention in FIG. 1. A brash 14 with adapter plate 16, vacuum hose 18, and rod 20 are shown within a rectangular duct 12, the duct 12 shown in partial cutaway. As seen in this Figure, the brush 14 is sized to fit snugly within the duct 12 in order that bristles 30 are in scraping and abrading contact with the inner surface of the duct 12.

Figure 2:
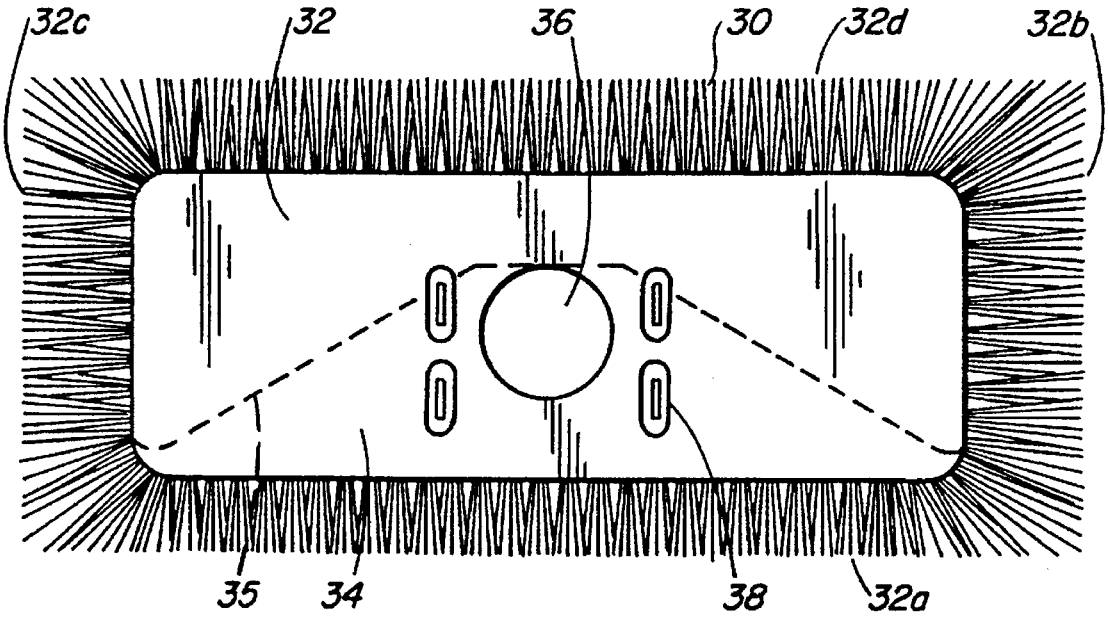
FIG. 2 is a top view of a brush in accordance with the invention for use in rectangular profile ducts.
Figure 3:
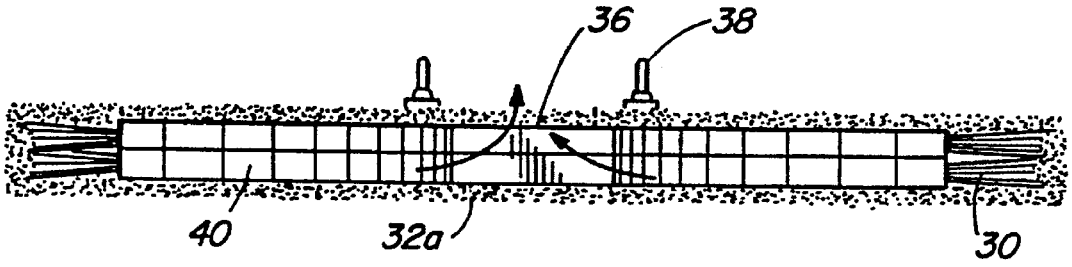
FIG. 3 is a bottom view of the brush of FIG. 2.

With reference to FIG. 2, the brush 14, is shown having a rectangular body 32 with bottom surface 32*a*, side surfaces 32*b* and 32*c* and top surface 32*d*, each surface having outwardly projecting bristles 30. The body 32 is provided with a hollow 34 extending from the bottom surface 32*a* toward the centre of the body 32 as shown by dotted line 35 in FIG. 2. The brush 14 is further provided with a vacuum aperture 36 in the major front surface of body 32 in communication with hollow 34. Locking stanchions 38, are provided on the front surface of the brush 14 for connection of the adapter plate 16 to the brush 14. FIG. 3 shows a bottom view of the brush 14 with hollow 34 and channel 40. As can be seen from FIG. 3, the lower surface 32*a* of the body 32 is provided with bristles 30 on each side of the channel 40 and hollow 34.

Figure 4:
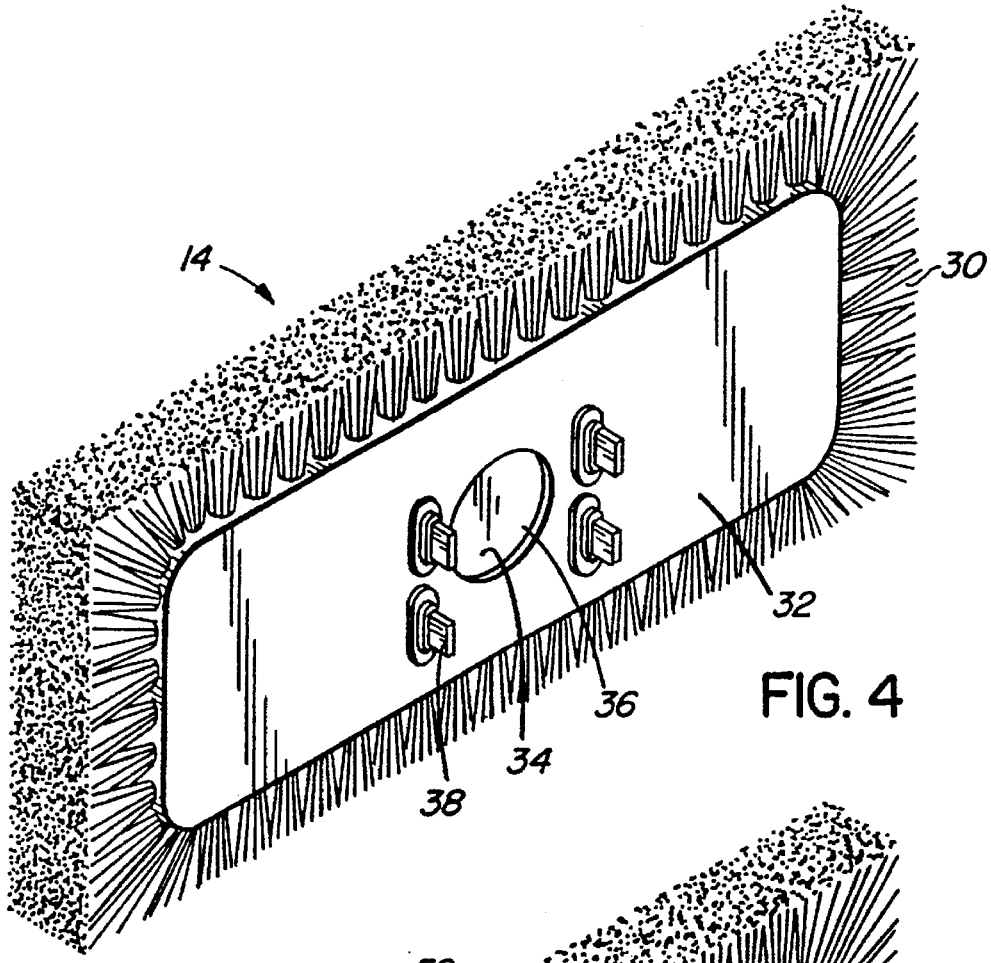
FIG. 4 is a perspective view of a brush of FIG. 2 showing the locking extensions in an unlocked configuration.
Figure 5:
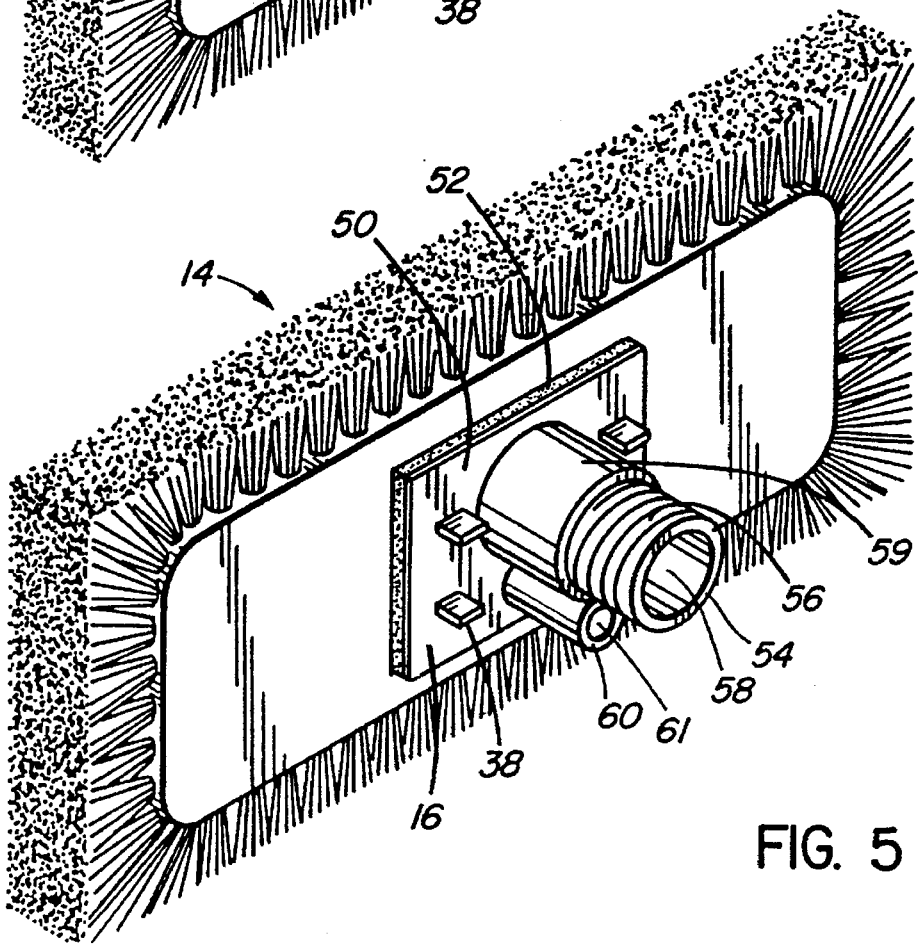
FIG. 5 is a forward perspective view of the brush of FIG. 2 showing the adapter plate and locking extensions on the brush.

FIGS. 4 and 5 show a forward perspective view of the brush 14 and the manner in which the adapter plate 16 is lockingly engaged upon the body 32 of the brush 14 by means of locking stanchions 38.

Figure 6:
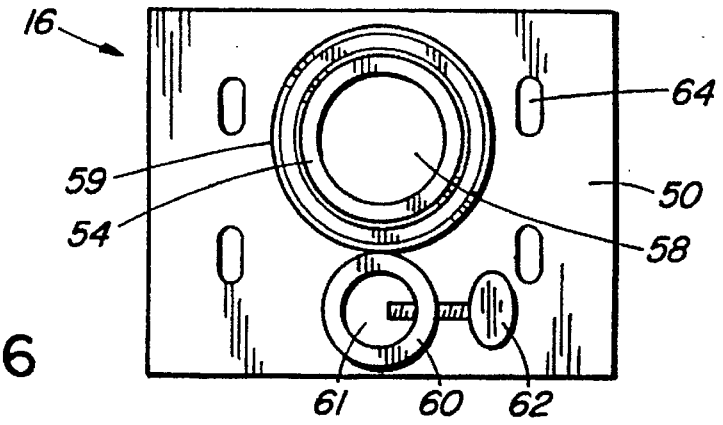
FIGS. 6, 7 and 8 are an end, side and forward perspective view of the adapter plate in accordance with the invention.
Figure 7:
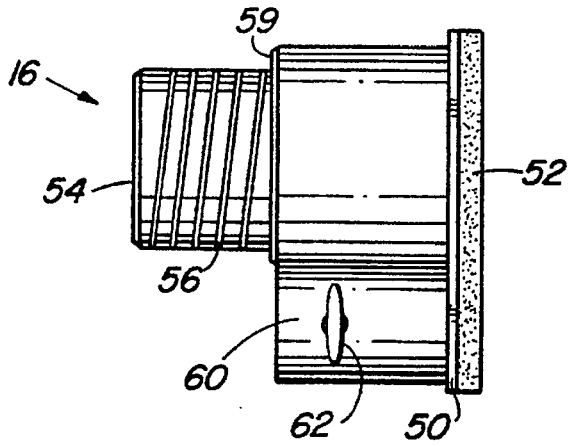
Figure 8:
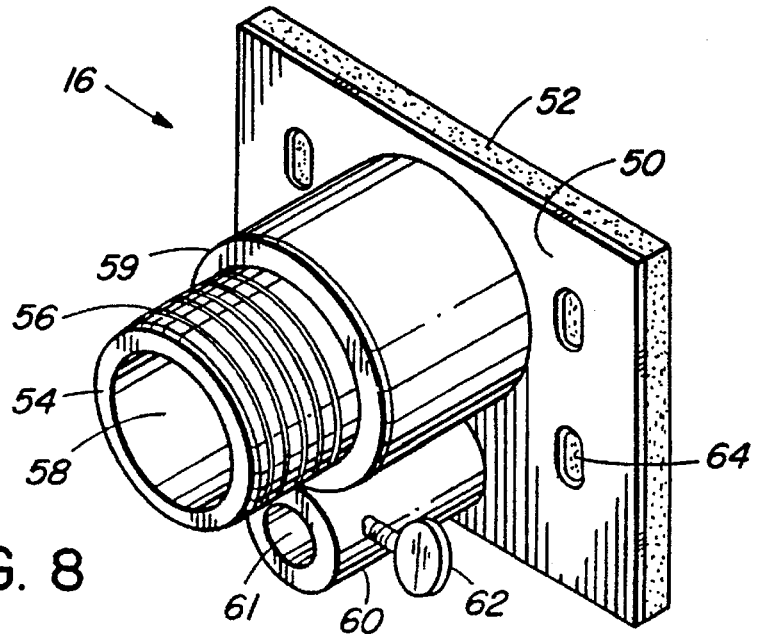
Figure 9:
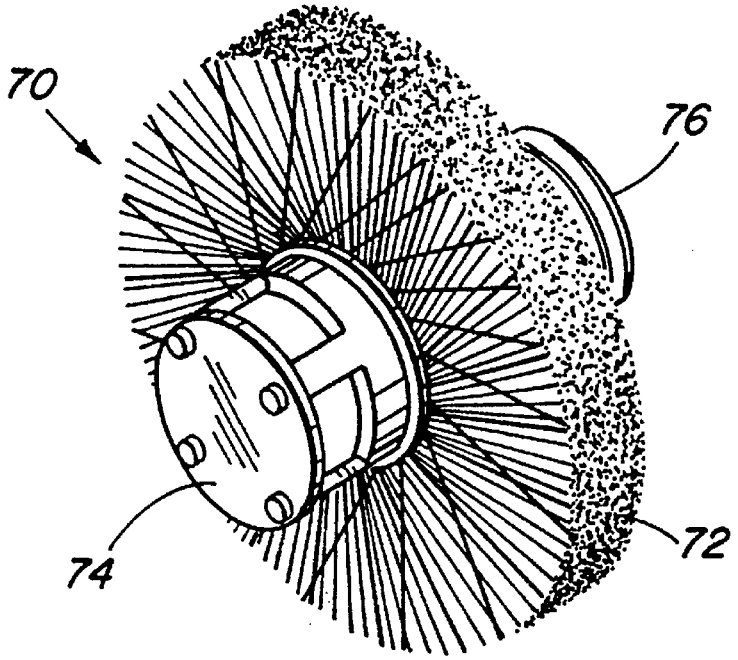
FIGS. 9 and 10 are a forward perspective and side view of a round brush in accordance with an alternative embodiment of the invention.
Figure 10:
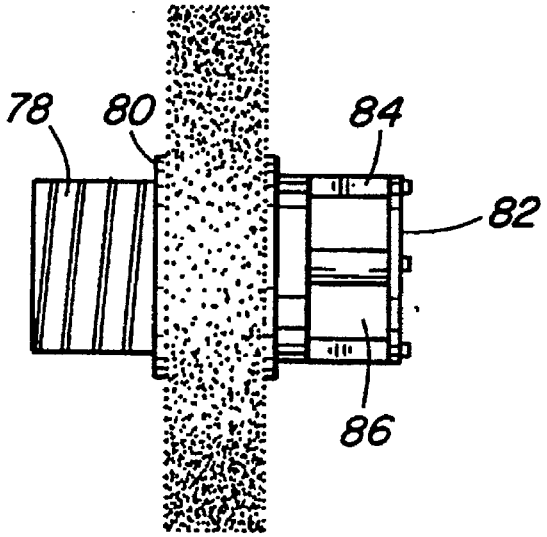

In a preferred form, the adapter plate 16 is provided with a base 50 having a seal 52, a vacuum adapter 54 with threads 56, through bore 58, seat 59, rod adapter 60 having thumb screw 62 and stanchion holes 64 as seen in FIGS. 6, 7 and 8 respectively.

Assembly of the duct cleaning system 10 is achieved by attaching vacuum hose 18 to adaptor plate 50 by screwing the end of a vacuum hose 18 having a suitable threaded end with threads 56 until the vacuum hose 18 seats against seat 59. Locking stanchions 38 are aligned with stanchion holes 64, the locking stanchions 38 passing through the stanchion holes 64 and are then turned by 90° in order to lock the adapter plate 50 against the brush body 32 to provide a tight sealing fit between the adaptor plate 16 and brush 14 as seen in FIGS. 1 and 5. Rod 20 is inserted in rod adaptor 60 and tightened with thumb screw 62. Other locking devices may be provided to effect attachment of the adaptor plate to the brush, such as but not being limited to nuts and bolts, hinges or any suitable combination thereof.

In accordance with an alternative embodiment of the invention, a round brush is provided for cleaning round ducts, the round brush 70 having outwardly extending bristles 72, a base 74 having a throughbore 76, threads 78 with a seat 80, end cap 82 with legs 84 and aperture 86. In this embodiment, the round brush is attached to a vacuum hose 18 as described above. The round brush 70 is typically provided with sorer bristles than those of a rectangular brush.

In both embodiments, the brush 14 or 70 may be readily connected to a vacuum hose to enable the duct cleaning technician to quickly and easily change the configuration of the brush for either rectangular or round ducts by unscrewing the brush 14 or 70 from the vacuum hose.

In operation, the duct cleaning technician opens the appropriate duct access port (not shown) within a duct system and determines the size of brush required for a tight fit within the duct. The appropriate brush is attached to the vacuum hose and the vacuum power source turned on. The technician is then able to effect cleaning of the duct by manipulating the brush within the duct either with rod 20 in the case of a rectangular brush or by vacuum hose 18 for a round brush 70.

As a result of the hollow design of the rectangular brush, highly effective vacuum power is positioned adjacent any debris on the lower surface of the duct. Accordingly, during manipulation of the brush, the lower bristles of the brush 14 dislodge debris adjacent the hollow portion of the brush which is then immediately picked up by the vacuum.

Any suitable dust entrapment apparatus may be used downstream to filter and collect the dirt and debris removed from the ventilation system.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The embodiments of the invention in which an exclusive property or privilege is claimed are defined as follows:

1. A duct cleaning apparatus comprising:

a brush member having a body with top, bottom, side, front and back surfaces, the bottom surface having a hollow base portion;

bristles extending outwardly from the top, bottom and side surfaces;

an aperture on the body extending from the front surface to the hollow base portion; and, connecting means;

adaptor means having a base portion having a brush side and mount side, the base portion with a vacuum aperture extending through said base from the brush side to the mount side;

vacuum hose connecting means on the mount side for receiving and connecting a vacuum hose to the vacuum aperture;

attachment means on the base portion for securing the adaptor means to the connecting means;

rod connector means on the mount side for connecting a rod to the base portion;

sealing means on the brush side for sealing the adaptor means with respect to the brush member.

2. Duct cleaning apparatus as in claim 1 wherein the bottom surface and hollow base portion define a perimeter lip around the bottom surface, the lip having a plurality of downwardly projecting bristles.

3. Duct cleaning apparatus as in claim 1 wherein the connecting means comprise locking stanchions adapted to co-operate with the attachment means on the base portion.

4. Duct cleaning apparatus as in claim 1 wherein the vacuum hose connecting means includes a threaded portion for connecting a vacuum hose to the base portion.

5. Duct cleaning apparatus as in claim 1 wherein the rod connecting means includes a rod receiving portion and thumbscrew for connecting a rod to the base portion.

6. Duct cleaning apparatus as in claim 1 wherein the sealing means is a rubber gasket on the brush side.

7. A duct cleaning apparatus comprising:

a brush member having:

a body with top, bottom and side surfaces and major front and back surfaces, the body having a hollow interior portion communicating through said bottom surface; bristles extending outwardly from the top, bottom and side surfaces; an aperture in the front surface of said body and communicating with said hollow interior portion; connecting means on said front surface of the body; and adaptor means including:

a base portion having a brush side and a mount side, the base portion having a vacuum aperture extending therethrough from the brush side to the mount side; vacuum hose connecting means on the mount side for receiving and connecting a vacuum hose to the vacuum aperture; attachment means on the base portion for firmly securing the adaptor means by way of the connecting means to said front surface of said body of the brush member with said aperture in said front surface of the body in communication with said vacuum aperture of said adaptor means; rod connector means on the mount side for connecting a rod to the adaptor means to provide for manipulation of the brush member back and forth within the duct;

whereby suction applied through a vacuum hose to the vacuum aperture causes air to flow into said body via said hollow interior which communicates with the bottom surface to effect cleaning of a duct within which said duct cleaning apparatus is located.

8. Duct cleaning apparatus as in claim 7 wherein said bottom surface of the body is in the form of a perimeter lip defined by and surrounding that part of the hollow interior portion communicating through said bottom surface, said perimeter lip having said bristles projecting outwardly therefrom.

9. Duct cleaning apparatus as in claim 7 wherein said connecting means comprises locking stanchions and said attachment means on said base portion comprise openings through which said locking stanchions may pass when the adapter means is mounted to said brush member, said locking stanchions being rotatable to effect locking of the adapter means to the front surface of the body of the brush member.

* * * * *